US007510254B2

(12) United States Patent
Yun et al.

(10) Patent No.: US 7,510,254 B2
(45) Date of Patent: Mar. 31, 2009

(54) IMAGE FORMING APPARATUS AND METHOD THEREOF

(75) Inventors: Young-jung Yun, Suwon-si (KR); Young-bok Ju, Seongnam-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 158 days.

(21) Appl. No.: 11/327,487

(22) Filed: Jan. 9, 2006

(65) Prior Publication Data

US 2006/0268038 A1 Nov. 30, 2006

(30) Foreign Application Priority Data

May 27, 2005 (KR) ..... 10-2005-0044827

(51) Int. Cl.
*B41J 2/205* (2006.01)

(52) U.S. Cl. ..... 347/15; 347/41

(58) Field of Classification Search ..... 347/9, 347/12, 16, 40–43, 15
See application file for complete search history.

(56) References Cited

U.S. PATENT DOCUMENTS 5,971,524 A * 10/1999 Nicoloff et al. ..... 347/43
6,318,832 B1 11/2001 Bates et al.
6,345,879 B1 * 2/2002 Fisher ..... 347/40
6,398,332 B1 * 6/2002 Silverbrook et al. ..... 347/12
6,663,222 B2 * 12/2003 Verhoest et al. ..... 347/40
6,890,060 B2 * 5/2005 Yakura et al. ..... 347/41
6,926,384 B2 * 8/2005 Grose et al. ..... 347/40
2001/0030669 A1 10/2001 Mitzutani

FOREIGN PATENT DOCUMENTS

JP 11-348246 12/1999
JP 2001-130112 5/2001
JP 2002-086767 3/2002
JP 2004-058283 2/2004

* cited by examiner

*Primary Examiner*—Thinh H Nguyen
(74) *Attorney, Agent, or Firm*—Roylance, Abrams, Berdo & Goodman, L.L.P.

(57) ABSTRACT

An image forming apparatus and a method thereof for preventing degradation of image quality by a malfunctioning nozzle are disclosed. The image forming apparatus includes a print head including a first nozzle line having a plurality of nozzles arranged with a predetermined pitch I and a second nozzle line disposed at predetermined distance D from the first nozzle line and having a plurality of nozzles arranged to be deviated from the nozzles of the first nozzle line with a predetermined pitch I. A controller controls the print head to inject ink to form at least a portion of dots to be overlapped by ink injected from the nozzles of the first nozzle line.

12 Claims, 9 Drawing Sheets

IMAGE FORMING APPARATUS AND METHOD THEREOF

CROSS-REFERENCE TO RELATED APPLICATIONS

This application claims the benefit under 35 U.S.C. § 119(a) of Korean Patent Application No. 2005-44827, filed May 27, 2005, in the Korean Intellectual Property Office, the entire disclosure of which is hereby incorporated by reference.

BACKGROUND OF THE INVENTION

1. Field of the Invention

The present invention relates to an image forming apparatus and a method thereof. More particularly, the present invention relates to a page printing type image forming apparatus and a method thereof.

2. Description of the Related Art

An ink-jet type image forming apparatus injects ink drops on a printing medium, such as paper, to form an image on the printing medium. The ink-jet type image forming apparatus is classified into line printing types and page printing types. The line printing type image forming apparatus includes a print head that injects ink drops and reciprocates the print head in a width direction of a printing medium to form an image. The page printing type image forming apparatus also includes a print head, and a plurality of nozzles are arranged in the print head that are as long as a width of the printing medium. The page printing type image forming apparatus forms images in a line of the printing medium at once while the printing medium is being conveyed.

Such an ink-jet type image forming apparatus generally includes a head chip, a plurality of nozzles and heaters to inject ink. However, the heater is easily deteriorated or an ink-injection passage is blocked because of the inferior head chip or long-time use. As a result, some of nozzles malfunction and the malfunctioning nozzle cannot properly inject ink. Therefore, an image quality of the ink-jet type image forming apparatus is seriously degraded by the malfunctioning nozzles.

A line printing type image forming apparatus can prevent degradation of image quality caused by a malfunctioning nozzle. That is, the line printing type image forming apparatus controls movement of a print head or controls a conveying speed of a printing medium to correct images distorted by the malfunctioning nozzles. However, a page printing type image forming apparatus cannot prevent degradation of image quality caused by the malfunctioning nozzles because a print head is un-movably fixed in the page printing type image forming apparatus.

FIGS. 1A and 1B show images formed by nozzles of a conventional page printing type image forming apparatus.

Referring to FIG. 1A, nozzles (NZ) of the page printing type image forming apparatus are arranged in a first nozzle line R1 and a second nozzle line R2, which are separated by a predetermined distance D in a conveying direction of a printing medium. The nozzles in the first nozzle line R1 are arranged to be deviated from the nozzles in the second nozzle line R2. Each of the nozzles is controlled to form a dot having a diameter as long as a nozzle gap I, which is a distance between two adjacent nozzles in same nozzle line. If one of the nozzles malfunctions, a white line MNL is formed as shown in FIG. 1B because the malfunctioning nozzle cannot inject ink to form dots on the printing medium. Such a white line is a critical factor in the degradation of image quality since the white line MNL is easily identified by a user.

Accordingly, a need exists for a image forming apparatus having an improved print head to substantially prevent degradation of image quality due to a malfunctioning nozzle.

SUMMARY OF THE INVENTION

Accordingly, the present general inventive concept has been made to solve the above-mentioned problems. An aspect of the present general inventive concept is to provide an image forming apparatus and a method thereof for preventing degradation of image quality caused by a malfunctioning nozzle.

In accordance with an aspect of the present invention, an image forming apparatus includes a print head including a first nozzle line having a plurality of nozzles arranged with a predetermined pitch I, and a second nozzle line disposed at a predetermined distance D from the first nozzle line and having a plurality of nozzles arranged to be deviated from the nozzles of the first nozzle line with a predetermined pitch I. A controller controls the printing head to inject ink to form at least a portion of dots to be overlapped by ink injected from the nozzles of the first nozzle line.

In an exemplary embodiment of the present invention, the controller may control the printing head to inject ink to form at least a portion of dots to be overlapped by ink injected from the nozzles of the second nozzle line. The controller may control the printing head to inject the ink to form the dots to have a diameter of 3I/2.

In another exemplary embodiment of the present invention, the controller may select every other one of the nozzles in the first nozzle line to inject ink on a first line (L1-1) of a printing medium, and control unselected nozzles in the first nozzle line to inject ink on a second line (L1-2) after conveying the printing medium a predetermined distance D1 from the first line (L1-1). Alternatively, the controller may select two nozzles for every other nozzle in the second nozzle line to inject the ink on the first line (L1-1) of the printing medium, and select two nozzles for every another nozzle in the second nozzle line to inject ink on the second line (L2-2). The predetermined distance D1 may be set as 3I/4.

In accordance with another aspect of the present invention, a method of forming images includes using a first nozzle line having M1 number of nozzles arranged with a predetermined pitch I and a second nozzle line having M2 number of nozzles arranged with a predetermined pitch I to be deviated from the nozzles of the first nozzle line. The second nozzle line is disposed a predetermined distance from the first nozzle line. M1 and M2 are positive integer numbers. The method includes selecting one of 2N1th nozzles and (2N1-1)th nozzles in the first nozzle line and forming images by controlling the selected nozzles to inject ink on a first line (L1-1) of a printing medium when N1 is a set of positive integer numbers from 1 to M1/2. Ink is injected on a second line (L1-2) of the printing medium using unselected one of 2N1th nozzles and (2N1-1)th nozzles in the first nozzle line after conveying the printing medium in a predetermined distance D1 from the first line (L1-1) . One group of nozzles is selected between a first group and a second group and forms images on the first line using the selected group of nozzles to inject ink when N2 is a set of positive integer numbers from 1 to M2/3. The first group includes 3N2th nozzles and (3N2-1)th nozzles in the second nozzle line, and the second group includes (3N2-1)th nozzles and (3N2-2)th nozzles in the second nozzle line. Images are formed on the second line using nozzles of the unselected group between the first group and the second group to inject the ink.

Other objects, advantages and salient features of the present invention will become apparent from the following detailed description, which, taken in conjunction with the annexed drawings, discloses exemplary embodiments of the present invention.

BRIEF DESCRIPTION OF THE DRAWINGS

The above aspects and features of the present invention will be more apparent by describing certain exemplary embodiments of the present invention with reference to the accompanying drawings, in which.

Throughout the drawings, like reference numerals will be understood to refer to like parts, components and structures.

DETAILED DESCRIPTION OF EXEMPLARY EMBODIMENTS

Certain exemplary embodiments of the present invention will be described in greater detail with reference to the accompanying drawings.

The matters defined in the detailed description, such as a detailed construction and elements thereof, are provided to assist in a comprehensive understanding of the invention. Thus, it is apparent that the present invention may be carried out without those defined matters. Also, well-known functions or constructions are omitted to provide a clear and concise description.

Figure 1A:
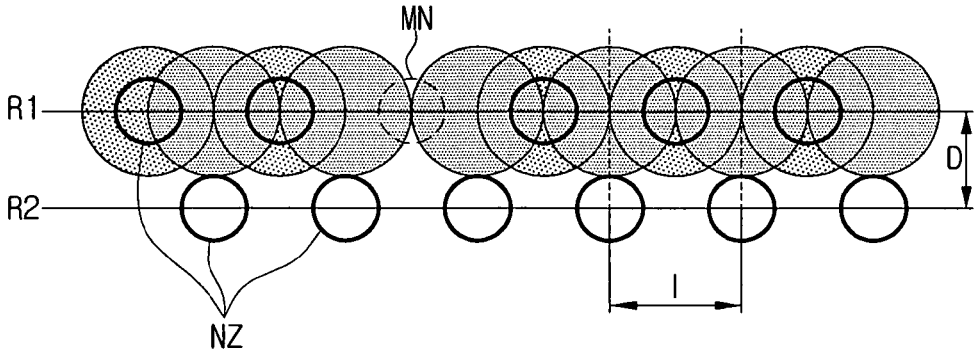
FIG. 1A (PRIOR ART)
FIGS. 1A and 1B show images formed by nozzles of an image forming apparatus according to the prior art.
Figure 1B:
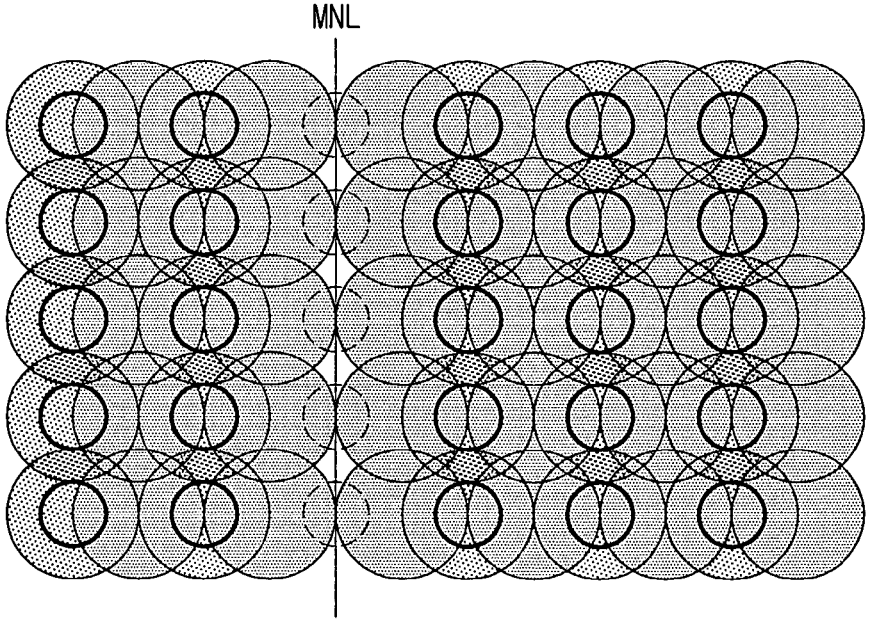
FIG. 1B (PRIOR ART)
Figure 2:
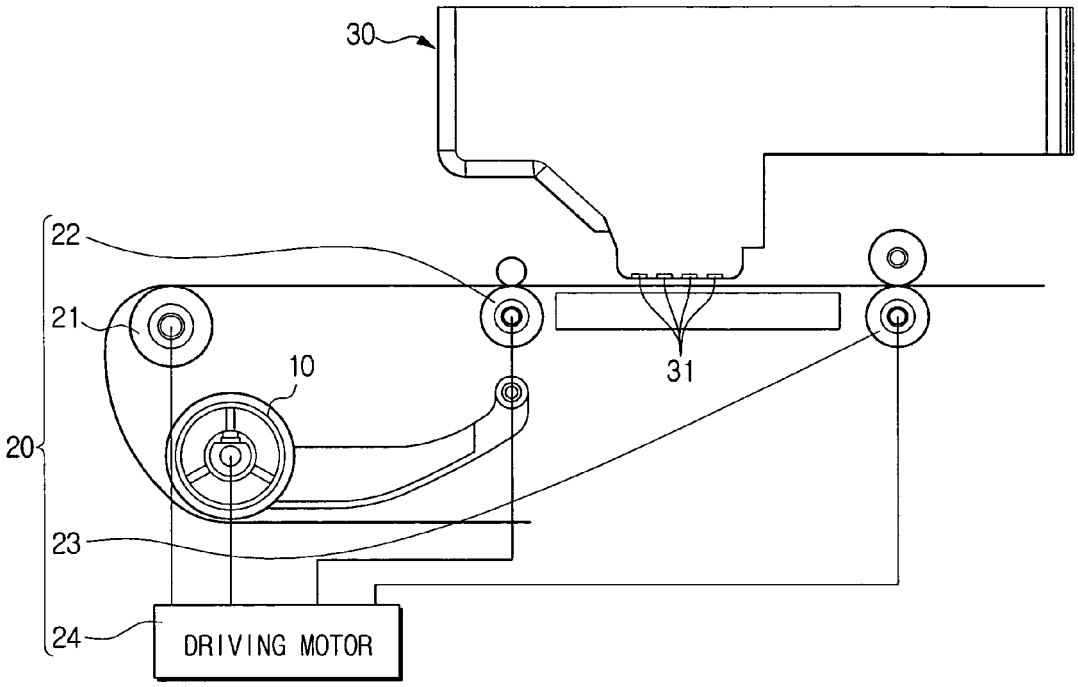
FIG. 2 is a side elevational view of an image forming apparatus according to an exemplary embodiment of the present invention.
Figure 3:
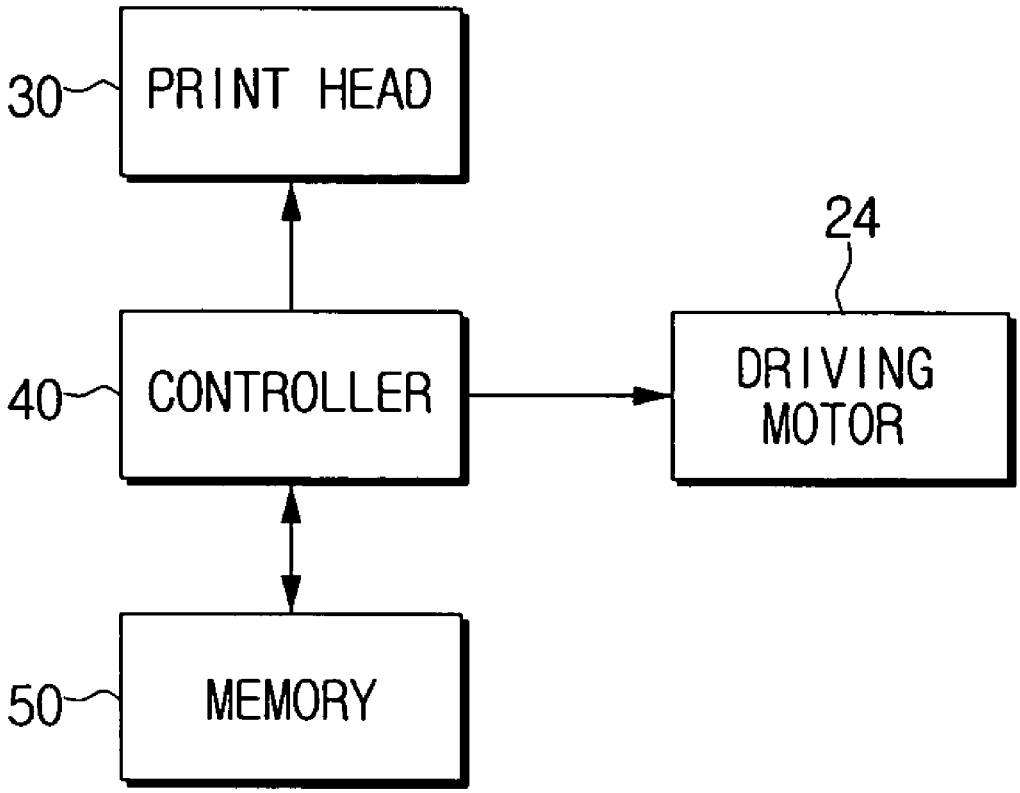
FIG. 3 is a block diagram illustrating a controller of the image forming apparatus of FIG. 2.

FIG. 2 is a side view of an image forming apparatus according to an exemplary embodiment of the present invention. FIG. 3 is a block diagram illustrating a controller of the image forming apparatus of FIG. 2.

Referring to the exemplary embodiment of FIGS. 2 and 3, the image forming apparatus includes a pickup roller 10 for picking up a printing medium from a paper cassette (not shown); a conveying unit 20 for conveying the printing medium picked up by the pickup roller 10; a print head 30 for forming images on the conveyed printing medium; and a controller 40.

The conveying unit 20 includes a drive roller 21 for guiding the printing medium picked-up by the pickup roller 10 to the print head 30; a feed roller 22 for conveying the guided printing medium to a bottom of the print head 30; a discharging roller 23 for discharging the printing medium after completely forming images on the printing medium by the print head 30; and a driving motor 24 for driving rollers 10, 21, 22 and 23. The pickup roller 10, the drive roller 21, the feed roller 22 and the discharging roller 23 are power-transferably connected to a power transferring unit, such as the driving motor 24 or a gear sequence (not shown). The driving motor 24 is connected to the controller 40 to exchange signals.

The print head 30 contains four colors of ink, preferably, yellow, magenta, cyan, and black, and includes four pairs of nozzle lines 31 to independently inject each color of the ink. Each of the nozzles preferably includes a heater (not shown) to inject ink and the heater is controlled in response to a signal transferred from the controller 40.

Figure 4A:
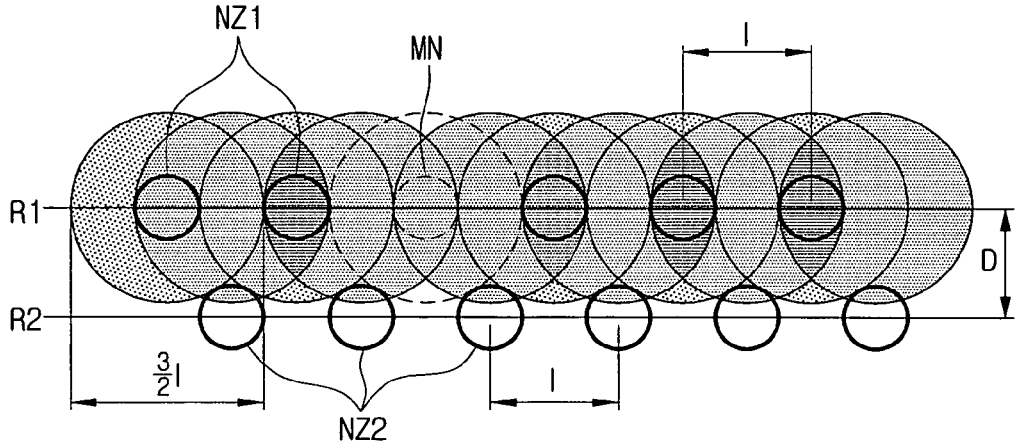
FIGS. 4A and 4B show images formed by an image forming apparatus according to an exemplary embodiment of the present invention.
Figure 4B:
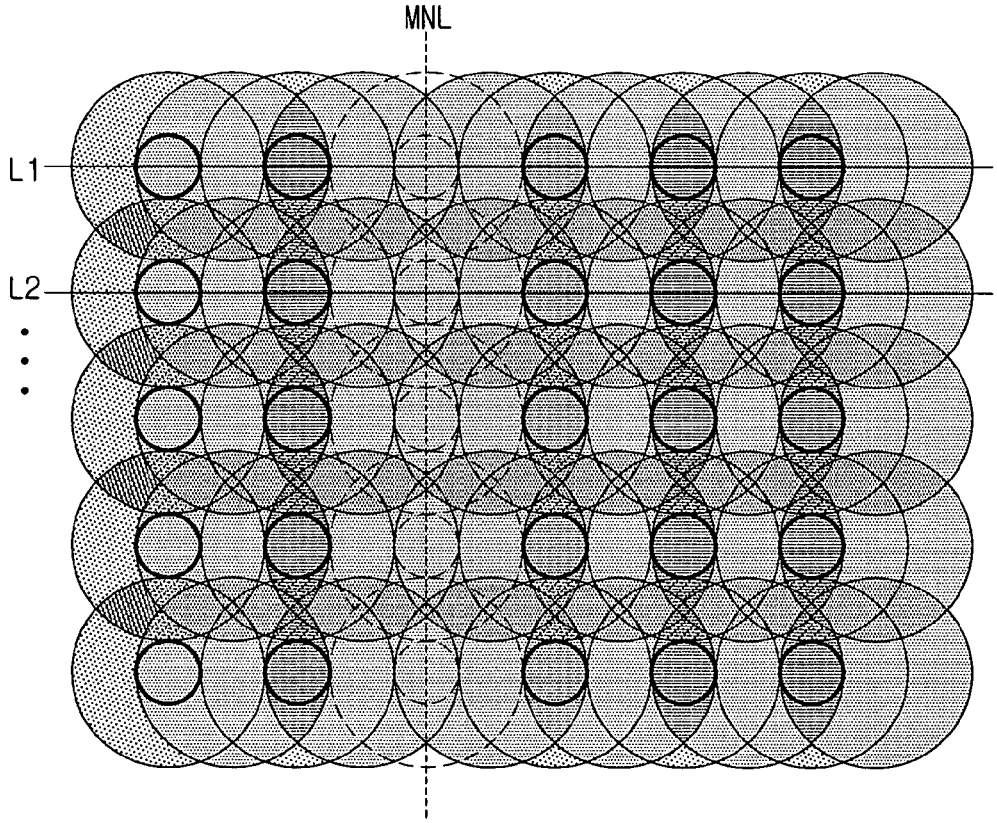

FIGS. 4A and 4B show images formed by a method of forming images according to a first exemplary embodiment of the present invention.

Referring to FIG. 4A, each of the nozzle lines 31 (FIG. 2) includes a first nozzle line R1 and a second nozzle line R2. The first nozzle line R1 has a plurality of nozzles NZ1 arranged in a width direction of a printing medium with a predetermined pitch I, and the second nozzle line R2 also has a plurality of nozzles NZ2 arranged in the width direction of the printing medium with a predetermined pitch I. The second nozzle line R2 is separated from the first nozzle line R1 by a predetermined distance (D) in a conveying direction of the printing medium. Since the four pairs of nozzle lines 31 have substantially identical structure, only one of the nozzle lines 31 is described in detail.

As shown in FIG. 4A, the nozzles NZ1 of the first nozzle line R1 are arranged as long as a width of the printing medium in the width direction of the printing medium with a predetermined pitch (I). The predetermined pitch I is dictated by the desired printing resolution of the image forming apparatus. For example, if the printing resolution is 600 dots per inch (dpi), the predetermined pitch I is set as 1/300 inch. The nozzles NZ2 of the second nozzle line R2 are arranged with a predetermined pitch I as are the nozzles of the first nozzle line R1. Each of the nozzles of the second nozzle line R2 is arranged at a middle position between every two adjacent nozzles of the first nozzle line R1. That is, each of the nozzles of the second nozzle line R2 is arranged at I/2 position between every two adjacent nozzles on the first nozzle line R1. Accordingly, the nozzles of the second nozzle line R2 are also arranged to be separated with 1/300 inch in a width direction of the printing medium. Preferably, the first nozzle line R1 and the second nozzle line R2 are separated by a predetermined distance D that is wider than the pitch I between two adjacent nozzles.

The controller 40 controls the driving motor 24 to drive each of the rollers 10, 21, 22 and 23. Also, the controller 40 controls the print head 30 to form images according to printing data by transmitting the printing data received from a host (not shown) to the print head 30. Specifically, the controller 40 controls each of the nozzles to inject ink by controlling the on and off status of the current applied to a heater (not shown). Furthermore, the controller 40 controls the amplitude of the current supplied to the heater to control an amount of ink injected by each nozzle.

The memory 50 (FIG. 3) stores control programs for driving the controller 40. Especially, amplitude of the current is determined and stored in the memory 50. The controller 40 transfers this determined amplitude of the current to each of the nozzles of the print head 30 to cause each of the nozzles to inject a predetermined amount of ink.

When the controller 40 transfers the amplitude of the current stored in the memory 50 to each of the nozzles in the print head 30, each of the nozzles injects ink to form dots on the printing medium according to the received amplitude of current. As a result, an image shown in FIG. 4A is formed. As shown in FIG. 4A, each of the dots has a diameter larger than the pitch I between two adjacent nozzles NZ. Such a dot, which has the larger diameter, may be formed by increasing the amplitude of the current transferred to each heater or using a heater having a larger capacity to inject a greater amount of ink. That is, it is preferable to form a dot having a diameter 3/2 times of the pitch I of the nozzles (NZ). That is, it is preferable to set an amount of injected ink to form a dot having a diameter 3I/2.

FIG. 4B shows images on a plurality of printing cycle lines L1, L2,. . ., Ln of a printing medium.

As shown in FIG. 4B, although one of nozzles is malfunctioning, adjacent nozzles of the malfunctioned nozzle correct a white line created by the malfunctioning nozzle by increasing an amount of ink injected from each of the nozzles NZ. Thus, even if one of nozzles NZ does not inject ink, it is not easily recognized by a user. Therefore, the degradation of image quality caused by the malfunctioning nozzle is substantially prevented according to an exemplary embodiment of the present invention.

FIGS. 5A through 5D show diagrams of a method of forming images according to a second exemplary embodiment of the present invention.

Referring to FIGS. 5A through 5D, the method of forming images according to the second exemplary embodiment controls a time of injecting ink from each of the nozzles or controls an order of injecting ink from the nozzles.

Figure 5A:
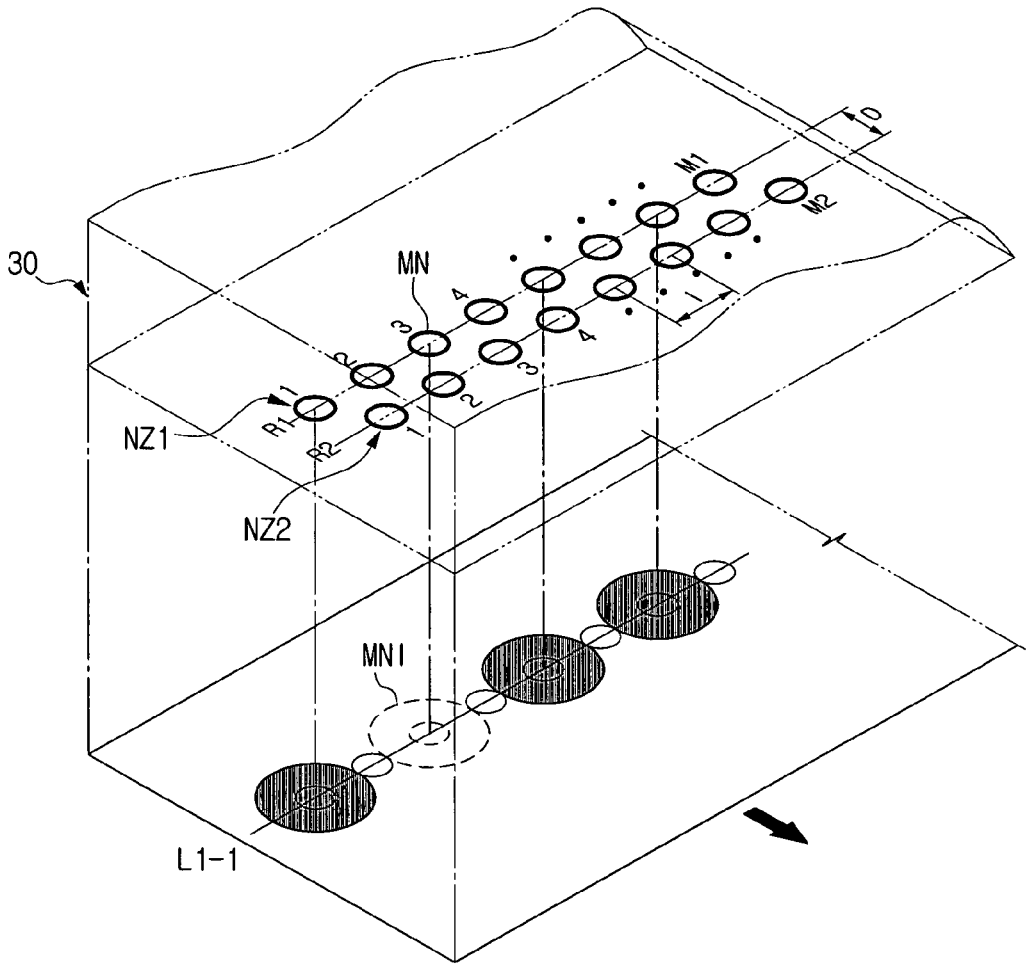
FIGS. 5A through 5D are views illustrating a method of forming an image according to an exemplary embodiment of the present invention.

Referring to FIG. 5A, nozzles NZ according to the second exemplary embodiment are arranged substantially identical to the nozzles of the first embodiment. That is, M1 nozzles NZ1 are arranged on a first nozzle line R1 with a predetermined pitch I in a width direction of a printing medium. A second nozzle line R2 is disposed a predetermined distance D from the first nozzle line R1. The second nozzle line R2 also includes M2 nozzles NZ2 arranged with a predetermined pitch I, and each of the M2 nozzles NZ2 is arranged at a middle position of every two adjacent nozzles NZ1 in the first nozzle line R1.

The controller 40 transfers a printing signal to the print head 30 according to printing data transmitted from a host (not shown). Herein, the controller 40 controls odd numbers of nozzles NZ1 in the first nozzle line R1 to inject ink. That is, the controller 40 selects every other one of the nozzles NZ1 of the first nozzle line R1 to inject ink. In order to explain the described method of injecting ink in detail, it assumes that N1 denotes a set of numbers from 1 to M1/2. Under this assumption, the controller 40 selects one of $2N1^{th}$ nozzles and $(2N1\text{-}1)^{th}$ nozzles and controls the selected nozzles to inject ink on a first line (L1-1) of a printing medium according to printing data.

Figure 5B:
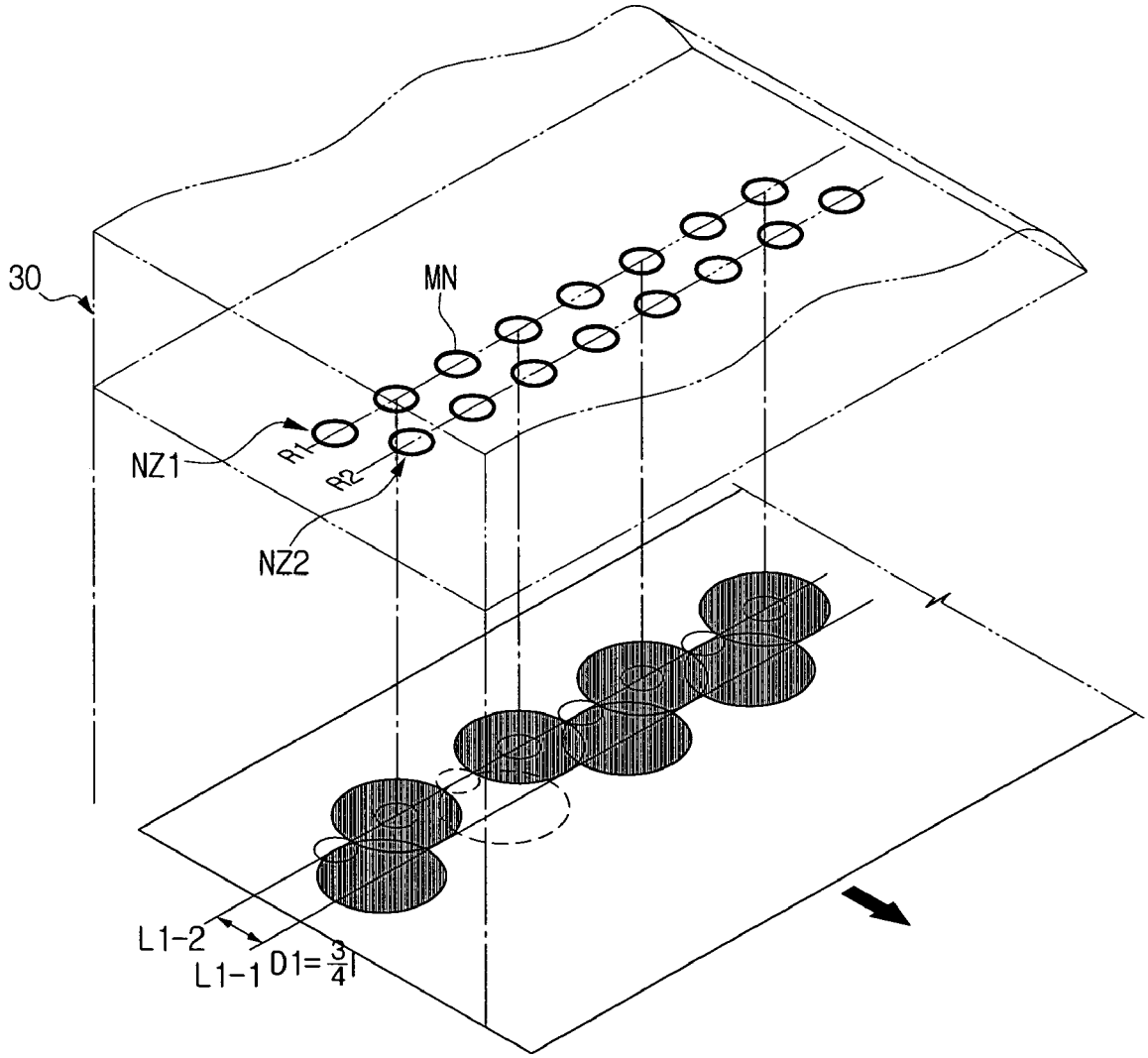

When the printing medium is conveyed in a predetermined distance D1 after forming images on the first line (L1-1), the controller 40 controls an even numbers of nozzles in the first nozzle line R1 to inject the ink on a second line (L1-2) of the printing medium according to the printing data as shown in FIG. 5B. That is, the even numbers of the nozzles in the first nozzle line R1 are nozzles not injecting the ink when the images are formed on the first line (L1-1). The controller 40 controls the unselected one of $2N1^{th}$ nozzles and $(2N1\text{-}1)^{th}$ nozzles to inject the ink on the second line (L1-2) of the printing medium, which is distanced from the first line (L1-1) by a predetermined distance D1, according to the printing data. Therefore, the images of the second line (L1-2) are formed separated from the images of the first line (L1-1) by a predetermined distance D1. Herein, the predetermined distance D1 is 0.75 times of the pitch I. That is, it is preferable that the predetermined distance D1 is 3I/4. In the second exemplary embodiment, the odd numbered nozzles NZ1 in the first nozzle line R1 first inject ink and then the even numbered nozzles NZ1 inject the ink. However, the order in which the nozzles inject the ink may be varied.

Figure 5C:
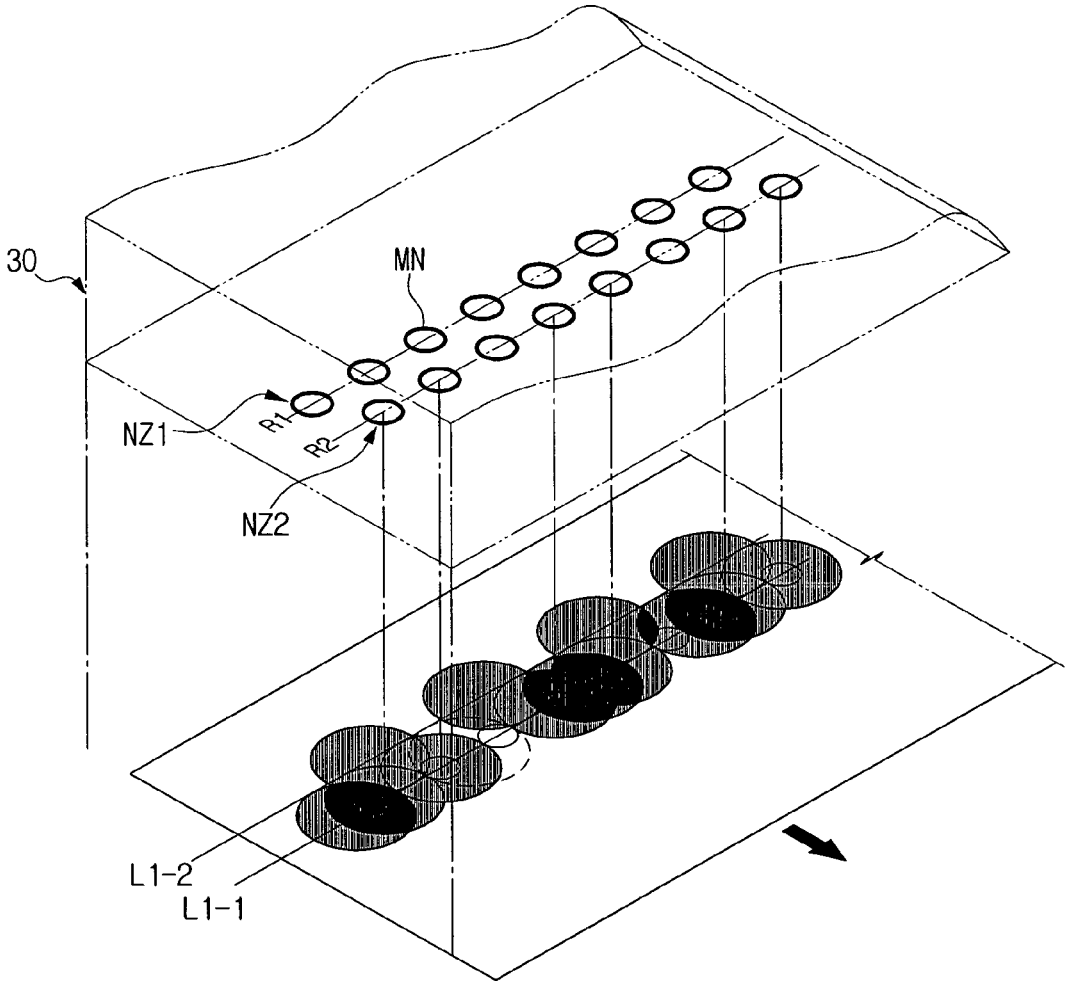

After the nozzles NZ1 of the first nozzle line R1 inject ink according to the printing data, the controller 40 conveys the printing medium in a predetermined distance (D-D1) to locate the printing medium under the second nozzle line R2, as shown in FIG. 5C. The predetermined distance (D-D1) may be calculated by subtracting a distance D1 from a distance D, where the distance D1 is a previously conveyed distance of the printing medium and the distance D is a distance between the first nozzle line R1 and the second nozzle line R2. That is, the printing medium is conveyed for the second nozzle line R2 to inject ink on the first line (L1-1) of the printing medium. When the first line (L1-1) of the printing medium is located under the second nozzle line R2, the controller 40 selects two nozzles for every other nozzle in the second nozzle line R2 to inject the ink on the first line (L1-1). In order to explain the method of selecting the nozzles in detail, it assumes that N1 is a set of numbers from 1 to M2/3. Also, it assumes that $3N2^{th}$ and $(3N2\text{-}1)^{th}$ nozzles NZ2 in the second nozzle line R2 are a first group, and $(3N2\text{-}1)^{th}$ and $(3N2\text{-}2)^{th}$ nozzles are a second group. Under the assumption, the controller 40 selects one of the first group and the second groups to inject the ink to form images according to the printing data.

Figure 5D:
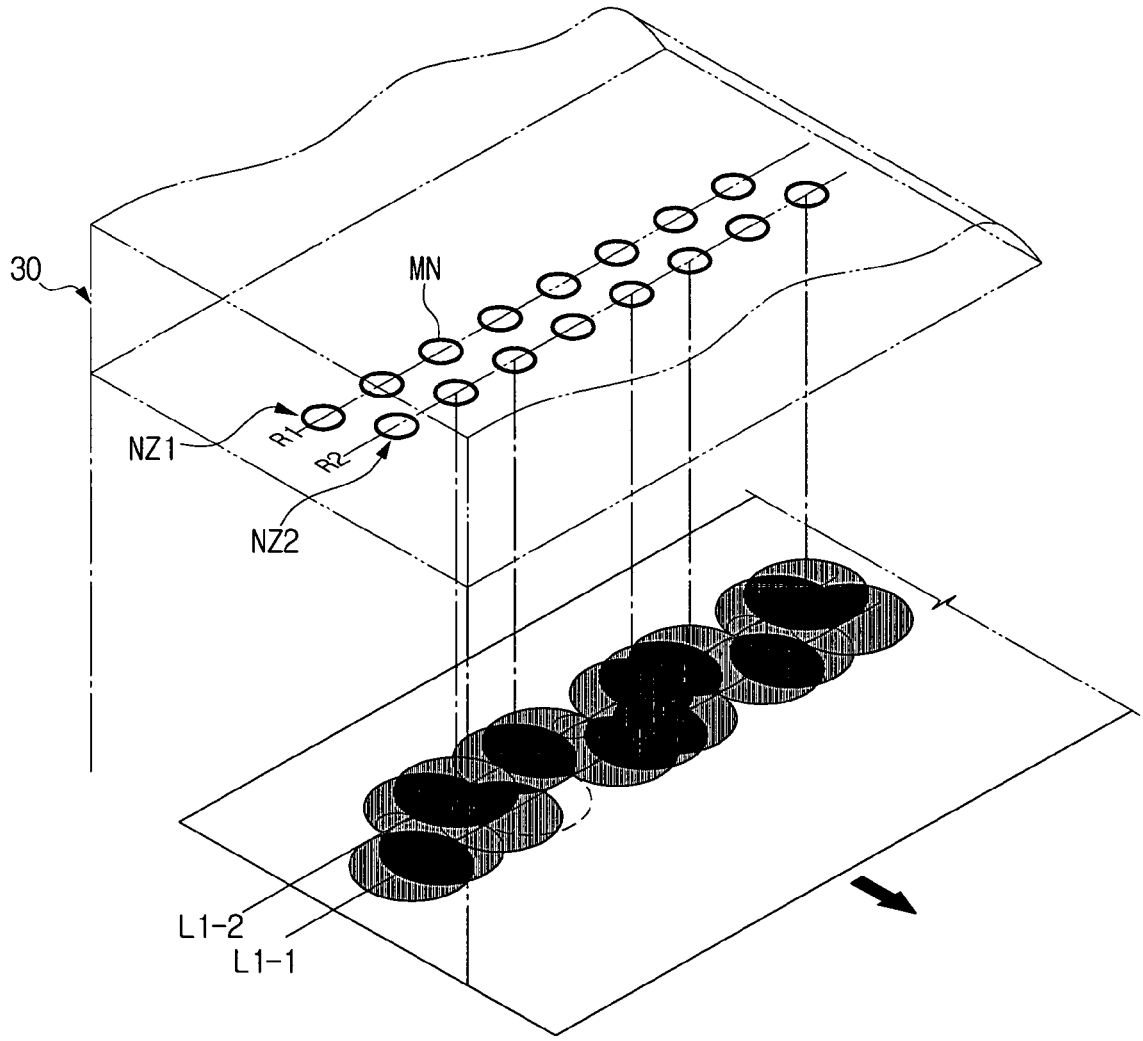

After the nozzles of the first group (NZ2) in the second nozzle line R2 form images on the first line (L1-1), the controller 40 conveys the printing medium a predetermined distance and controls the nozzles of the second group to inject ink on the second line (L1-2) of the printing medium according to the printing data, as shown in FIG. 5D.

Figure 6A:
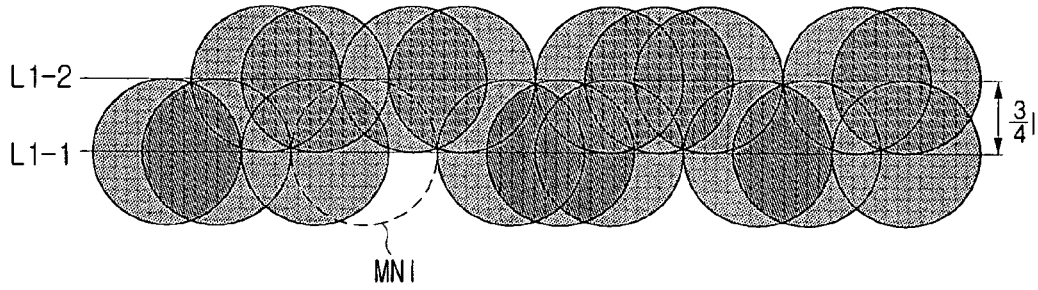
FIGS. 6A and 6B show images formed by a method of forming an image according to an exemplary embodiment of the present invention.

Then, images of a single printing cycle line (L1) are completely formed, as shown in FIG. 6A. As shown 6A, unformed image MN1 created by a malfunctioning nozzle is corrected by the adjacent nozzles.

Figure 6B:
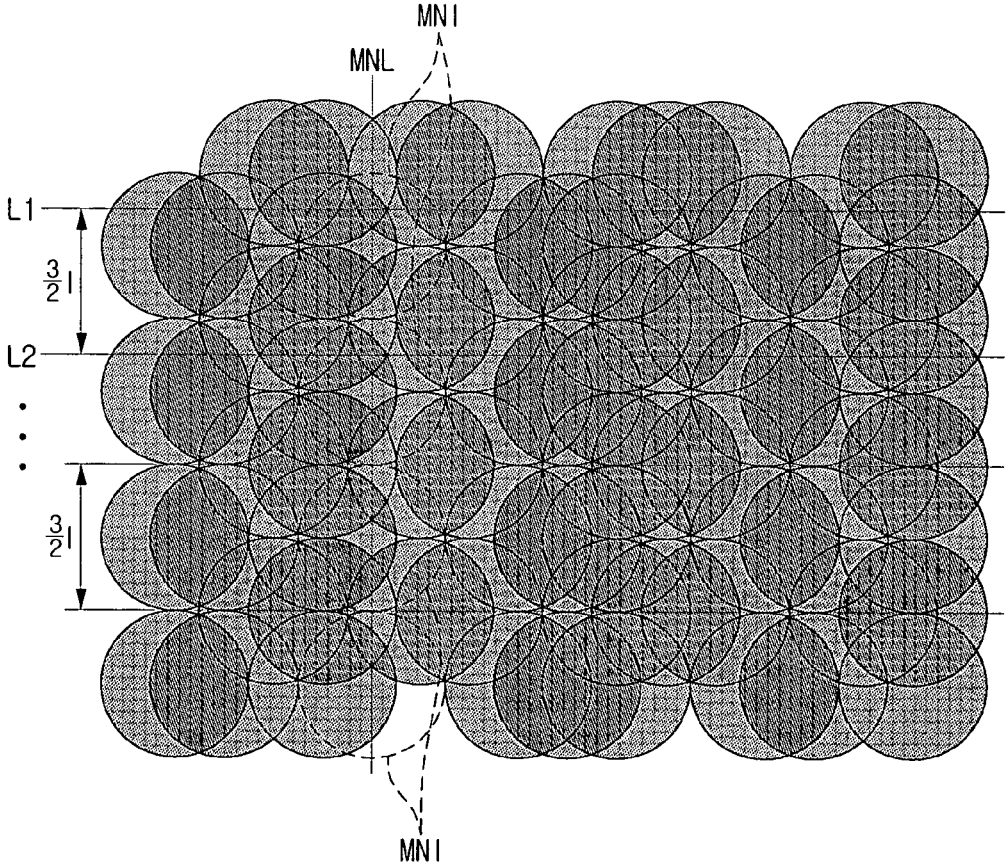

FIG. 6B shows images formed on a plurality of printing cycle lines L1, L2, . . . Ln.

As shown in FIG. 6B, un-formed images created by a malfunctioning nozzle MN are corrected by adjacent nozzles in the first nozzle line R1 and the second nozzle line R2. Therefore, the white line problem caused by a malfunctioning nozzle is substantially eliminated.

As described above, the degradation of image quality caused by the malfunctioning nozzles may be prevented by increasing a size of a dot formed by each nozzle according to an exemplary embodiment of the present invention.

Also, the distortion of the images caused by the malfunctioning nozzle may be effectively compensated by controlling a time and an order of injecting ink from the nozzles of each nozzle line.

The foregoing embodiments and advantages are merely exemplary and are not to be construed as limiting the present invention. The present teaching may be readily applied to other types of apparatuses. Also, the description of the exemplary embodiments of the present invention is intended to be illustrative, and not to limit the scope of the claims, and many alternatives, modifications, and variations will be apparent to those skilled in the art.

What is claimed is:

1. An image forming apparatus, comprising:

a print head including a first nozzle line having a plurality of nozzles arranged with a predetermined pitch I; and a second nozzle line disposed at a predetermined distance D from the first nozzle line and having a plurality of nozzles arranged to be deviated from the nozzles of the first nozzle line with a predetermined pitch I; and a controller for controlling the print head to inject ink to form at least a portion of dots to be overlapped by ink injected from the nozzles of the first nozzle line, wherein the controller controls the print head to inject ink to form at least a portion of dots to be overlapped by ink injected from the nozzles of the second nozzle line and controls the nozzles to inject the ink to form dots having a diameter of approximately 3I/2, and wherein the controller selects every other one of the nozzles in the first nozzle line to inject ink on a first line (L1-1) of a printing medium, and controls unselected nozzles in the first nozzle line to inject ink on a second line (L1-2) after conveying the printing medium a predetermined distance D1 from the first line (L1-1).

2. The image forming apparatus of claim 1, wherein the predetermined distance D1 is set as 3I/4.

3. The image forming apparatus of claim 2, wherein a conveying unit conveys a printing medium; and the controller controls a time of injecting ink on the printing medium conveyed by the conveying unit to control locations of hit points of ink injected from the first nozzle line and the second nozzle line.

4. An image forming apparatus, comprising:

a print head including a first nozzle line having a plurality of nozzles arranged with a predetermined pitch I; and a second nozzle line disposed at a predetermined distance D from the first nozzle line and having a plurality of nozzles arranged to be deviated from the nozzles of the first nozzle line with a predetermined pitch I; and a controller for selecting a first set of nozzles in the first nozzle line to inject ink of a first line (L1-1) of a printing medium, and controlling a second set of nozzles in the first nozzle line to inject ink of a second line (L1-2) after conveying the printing medium a predetermined distance D1 from the first line (L1-1), the second set of nozzles being the nozzles of the first nozzle line not in the first set, wherein the first set of nozzles is obtained by selecting two nozzles for every other nozzle in the second nozzle line.

5. The image forming apparatus according to claim 4, wherein the controller controls the print head to inject ink to form dots having a diameter of 3I/2 on the printing medium.

6. The image forming apparatus according to claim 4, wherein the predetermined distance D1 is set as 3I/4.

7. The image forming apparatus according to claim 4, wherein the nozzles of the second nozzle line are deviated in a width direction of the printing medium from the nozzles of the first nozzles line by ½ I.

8. A method of forming images using a first nozzle line having M1 number of nozzles arranged with a predetermined pitch I and a second nozzle line having M2 number of nozzles arranged with a predetermined pitch I to be deviated from the nozzles of the first nozzle line, and the second nozzle line being disposed a predetermined distance from the first nozzle line, where Ml and M2 are positive integer numbers, the method comprising the steps of selecting one of $2N1^{th}$ nozzles and $(2N1\text{-}1)^{th}$ nozzles in the first nozzle line and forming images by controlling the selected nozzles to inject ink on a first line (L1-1) of a printing medium when Ni is a set of positive integer numbers from 1 to M1/2;

injecting ink on a second line (L1-2) of the printing medium using the unselected one of $2N1^{th}$ nozzles and $(2N1\text{-}1)^{th}$ nozzles in the first nozzle line after conveying the printing medium a predetermined distance D1 from the first line (L1-1);

selecting one group of nozzles in the second nozzle line between a first group and a second group and forming images on the first line using the selected group of nozzles to inject ink when N2 is a set of positive integer numbers from 1 to M2/3, the first group includes $3N2^{th}$ nozzles and $(3N2\text{-}1)^{th}$ nozzles in the second nozzle line, and the second group includes $(3N2\text{-}1)^{th}$ nozzles and $(3N2\text{-}2)^{th}$ nozzles in the second nozzle line; and forming images on the second line using nozzles of the unselected group between the first group and the second group of the second nozzle line to inject the ink, wherein the predetermined distance D1 is 3I/4.

9. The method of claim 8, wherein at least portion of a dot formed on the printing medium by ink injected from one of the nozzles is overlapped by another dot formed by ink injected from another nozzle adjacent thereto.

10. The method of claim 9, wherein the diameter of the dot formed on the printing medium by ink injected from each of the nozzles is 3I/2.

11. The method of claim 8, wherein the nozzles of the second nozzle line are deviated in a width direction of the printing medium from the nozzles of the first nozzles line by ½ I.

12. An image forming apparatus, comprising:

a print head including a first nozzle line having a plurality of nozzles arranged with a predetermined pitch I; and a second nozzle line disposed at a predetermined distance D from the first nozzle line and having a plurality of nozzles arranged to be deviated from the nozzles of the first nozzle line with a predetermined pitch I; and a controller for controlling the print head to inject ink to form at least a portion of dots to be overlapped by ink injected from the nozzles of the first nozzle line, wherein the controller controls the print head to inject ink to form at least a portion of dots to be overlapped by ink injected from the nozzles of the second nozzle line and controls the nozzles to inject the ink to form dots having a diameter of approximately 3I/2, and wherein the controller selects two nozzles for every other nozzle in the second nozzle line to inject the ink on the first line (L1-1) of the printing medium, and selects two nozzles for every another nozzle in the second nozzle line to inject ink on the second line (L2-1).

* * * * *